United States Patent [19]

Duffaut

[11] Patent Number: 4,525,431

[45] Date of Patent: Jun. 25, 1985

[54] IRON-BASED ALLOYS FOR WELDED STRUCTURAL ELEMENTS, METHOD OF MANUFACTURING SUCH ELEMENTS AND STRUCTURES BUILT THEREFROM

[75] Inventor: Francois Duffaut, Nevers, France

[73] Assignee: Imphy S.A., Paris, France

[21] Appl. No.: 445,636

[22] Filed: Nov. 30, 1982

[30] Foreign Application Priority Data

Dec. 4, 1981 [FR] France ..... 81 22756

[51] Int. Cl.[3] ..... B22B 15/18

[52] U.S. Cl. ..... 428/638; 428/637; 420/580; 75/123 K

[58] Field of Search ..... 75/123 K, 123 M; 420/581, 580; 148/442; 428/638, 637

[56] References Cited

U.S. PATENT DOCUMENTS 3,184,577 1/1963 Witherell ..... 75/123 M
3,573,897 7/1971 Wache ..... 75/123 K
3,971,677 7/1976 Mason et al. ..... 75/123 K

FOREIGN PATENT DOCUMENTS 57-26144 2/1982 Japan ..... 75/123 K
0347363 9/1972 U.S.S.R. ..... 75/123 K

*Primary Examiner*—Peter K. Skiff
*Assistant Examiner*—Debbie Yee
*Attorney, Agent, or Firm*—Pollock, Vande Sande & Priddy

[57] ABSTRACT

The present invention relates to iron-based alloys with a low coefficient of expansion and to the uses of these alloys for welded structural elements operating under cryogenic conditions. The alloys according to the invention contain by weight 35 to 39% of nickel, 0 to 20% of cobalt, 0 to 0.25% of silicon, 0 to 0.04% of carbon, 0 to 0.004% of sulfur, 0 to 0.008% of phosphorus, manganese, the remainder being formed by iron and by impurities. They are characterized by the fact that they contain 0.2% to 1.5% of manganese and 0.2 to 0.5% of titanium.

3 Claims, 4 Drawing Figures

IRON-BASED ALLOYS FOR WELDED STRUCTURAL ELEMENTS, METHOD OF MANUFACTURING SUCH ELEMENTS AND STRUCTURES BUILT THEREFROM

BACKGROUND OF THE INVENTION

The present invention relates to iron-based alloys with a low coefficient of expansion and weldable and to the uses of these alloys in welded structural elements operating under cryogenic conditions, in particular for storage and transportation tanks and for pipes for conveying liquified gas.

The weldability of iron-nickel alloys having 35 to 50% of nickel, among which is the alloy known under the trade-mark "INVAR", is limited by two distinct phenomena: the tendency to a "solidification crack" and the "ductility gap". The phenomenon called "solidification crack" is due to the fact that interdendritic films are still liquid and hence unable to withstand a tensile force at a temperature where the dendrites already formed constitute a continuous solid edifice capable of transmitting the forces due to thermal contraction. The ductility gap corresponds to a ductility minimum in the temperature interval ranging from 700° to 1,000° C.

PRIOR ART

A filler metal is known, intended for the welding of the above alloys in which manganese and titanium have been added to the base metal of the above type. A typical composition of this filler metal comprises 36% of nickel, 0.1% silicon, 0.1% carbon, less than 0.01% of sulfur, less than 0.01% of phosphorus, 3% of manganese and 1% of titanium, the iron forming the remainder. The addition of manganese and of titanium has the drawback of raising the coefficient of expansion of the alloy which cannot for this reason be utilised as a basic metal for the manufacture of structural elements in the cryogenic field. In addition the use of this filler metal as a weld does not resolve all the difficulties. In the case of intersecting weld beads and if the stresses are rather high, fissurisations of the first weld bead occur in the zone affected by the second weld bead, not in the fused zone but just at the limit of the latter in the base metal.

It has been proposed, in French Pat. No. 71 293 41 for structural elements in the cryogenic field, to provide iron-nickel alloys with manganese added and having a limited sulfur content. These alloys comprise by weight, 36 to 36.5% of nickel, 0 to 0.25% of silicon, 0 to 0.04% of carbon, 0 to 0.012% of sulfur, 0 to 0.012% of phosphorus and 0.20 to 0.40% of manganese. On account of the limiting of the sulfur content and the presence of manganese, the structural elements formed with these alloys may be welded without great difficulty. It is observed nonetheless that the metal of the fused zone of a weld formed with this alloy is incapable of withstanding simultaneously, a temperature of the order of 700° to 1,000° C. and a tensile stress, whereas these conditions are encountered on the local reformation of a weld bead or of a weld bead intersection. This phenomenon is due to the drop in ductility observed in the range of temperatures given above.

SUMMARY OF THE INVENTION

It is an object of the present invention to provide iron-based alloys intended for welded structural elements operating under cryogenic conditions, not having a marked "ductility gap", nor an unacceptable tendency to a solidification "crack". These alloys have a mean coefficient of expansion between −180° and 0° C. less than or in the vicinity of $2.10^{-6}$/°C. and the present invention relates to applications requiring the above properties.

Iron-based alloys for structural elements operating at cryogenic temperatures according to the invention contain by weight 35 to 39% nickel, 0 to 20% of cobalt, 0 to 0.25% of silicon, 0 to 0.04% of carbon, 0 to 0.004% of sulfur, 0 to 0.008% of phosphorus, manganese, the remainder being formed by iron and by impurities and they are characterised by the fact that they contain 0.2 to 1.5% of manganese and 0.2% to 0.5% of titanium.

According to one feature, the alloys contain 0.3 to 1% of manganese.

According to another feature of the invention, these alloys are used in the manufacture of structural elements having weld intersections.

BRIEF DESCRIPTION OF THE DRAWINGS

The invention will now be described in more detail with reference to embodiments given purely by way of example. This description is in no way limiting and refers to the accompanying drawings in which.

The alloys according to the invention are based on iron and contain 35 to 39% of nickel. They have an austenitic structure. They may contain 0 to 20% of cobalt.

EXAMPLE

By way of example, the table gives two compositions of alloys according to the invention. These compositions are given by weight.

TABLE I

| | Ni | Si | C | S | P | Mn | Ti | Fe |
|---|---|---|---|---|---|---|---|---|
| M1 | 36 | 0.25 | 0.03 | 0.004 | 0.008 | 0.3 | 0.2 | Remainder |
| M2 | 36 | 0.25 | 0.03 | 0.004 | 0.008 | 0.5 | 0.4 | Remainder |

Figure 3:
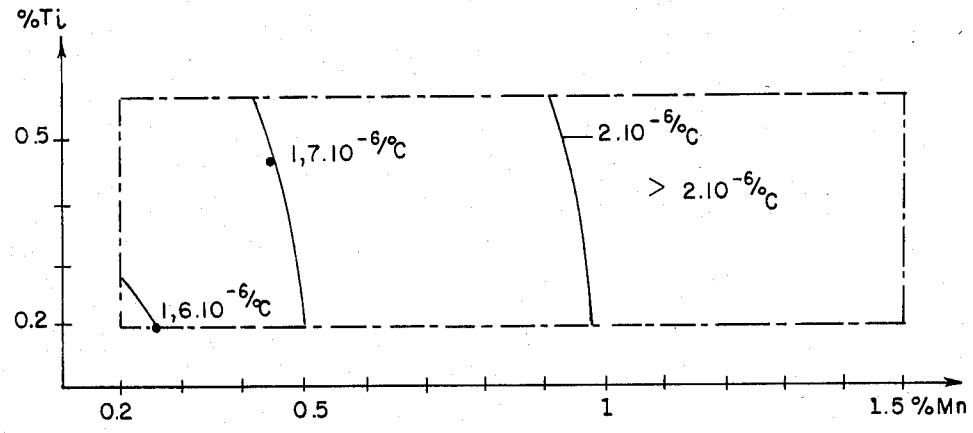
FIG. 3 is a graph showing the mean coefficient of expansion between −180° and 0° C. of alloys according to the invention.

The alloys contain manganese and titanium. The combination of the addition of manganese and the addition of titanium is essential. In fact, the addition of manganese alone, even at the level of 3%, is without effect on the "ductility gap". The mangenese content is comprised between 0.2 and 1.5%. Preferably it must not exceed 1% in order that the mean coefficient of expansion between −180° and 0° is low (FIG. 3). Preferably the content is comprised between 0.3% and 1%.

Figure 1:
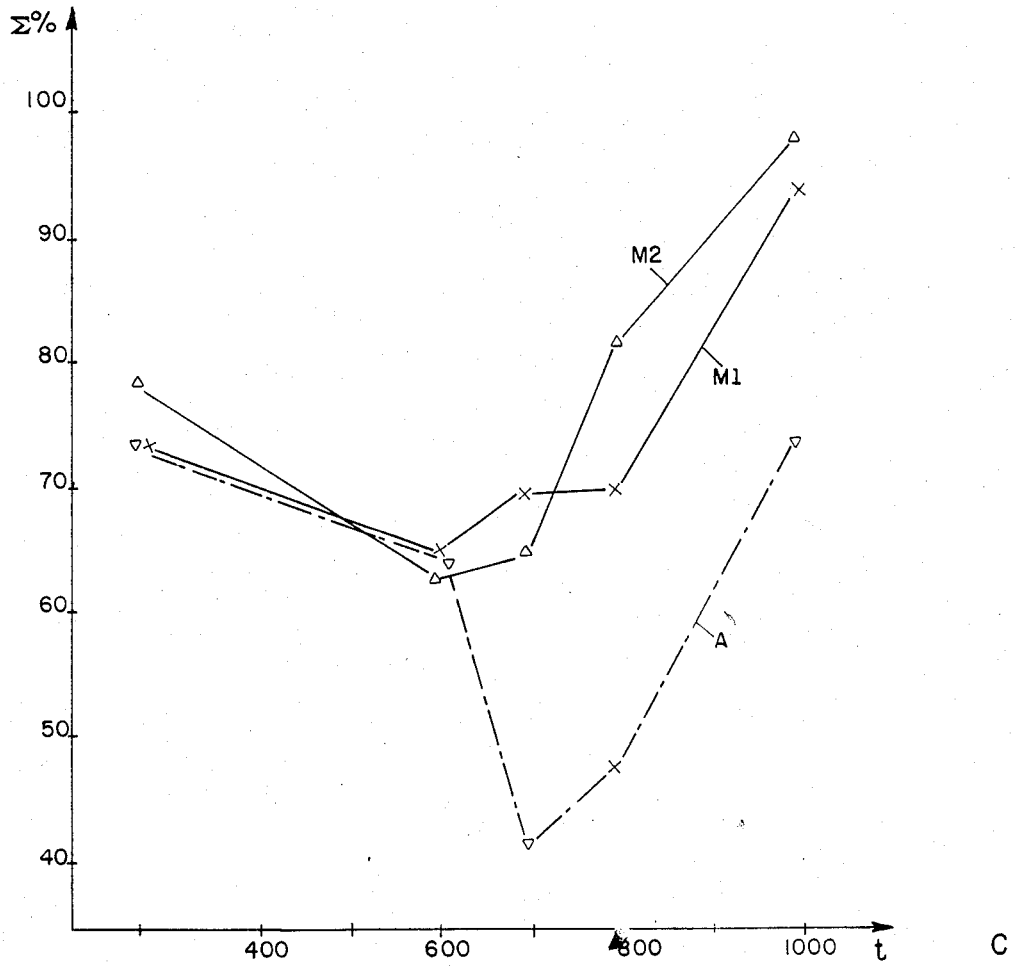
FIG. 1 is a graph showing the reduction of area on rupture measured by the rapid tensile test on forged samples and processed for one hour at 1100° C., according to the temperature t.

The minimum content of titanium, equal of 0.2%, is critical in that it relates to the "ductility gap". In fact, the latter is not eliminated reproducibly when the titanium content is less than the limit mentioned. Thus the reduction in area on rupture graph (FIG. 1) of the alloy A whose composition by weight is given in Table II shows that the "ductility gap" exists when the titanium content is less than 0.2%.

TABLE II

| | Ni | Si | C | S | P | Mn | Ti | Fe |
|---|---|---|---|---|---|---|---|---|
| A | 36 | 0.25 | 0.03 | 0.002 | 0.008 | 0.26 | 0.12 | Remainder |

On the contrary, the reduction in area on rupture graphs of the alloys M1 and M2 (FIG. 1) show that the "ductility gap" is eliminated in alloys according to the invention containing more than 0.2% of titanium.

The minimum content of titanium is, in addition, critical from the point of view of weldability. In fact, tests show that the alloys according to the invention do not present cracks at weld intersections whereas alloys such as alloy A show them occasionally and titanium-free alloys show them systematically.

The titanium content must not exceed 0.5% to avoid increasing the mean coefficient of expansion and to avoid aggravating the tendency to the solidification crack.

Figure 2:
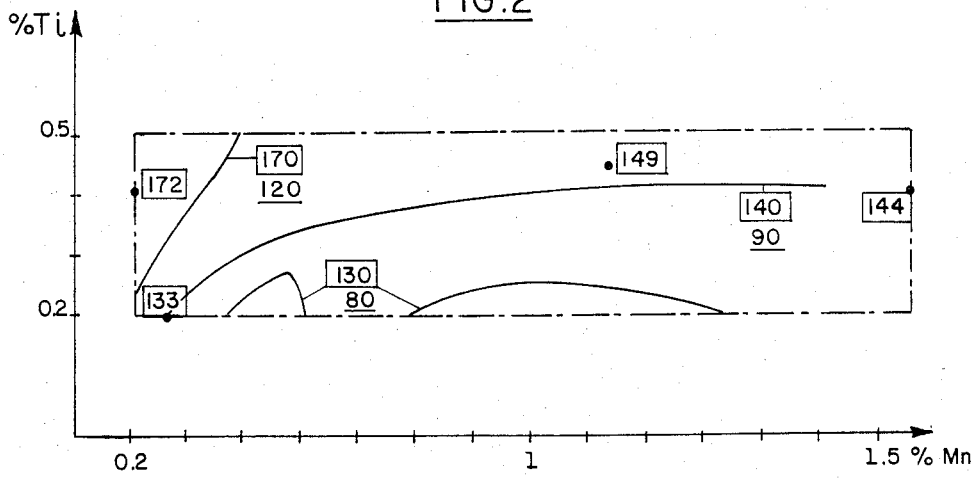
FIG. 2 shows for various contents of manganese and of titanium according to the invention, a definite "mark" according to the Gueussier-Castro method, and the tendency to the defect called the "solidification crack", this tendency being all the greater as the mark is higher.

The sulfur content is comprised between 0 and 0.004%. The graph of FIG. 2 shows that in the field of the alloys according to the invention, the drop in sulfur content of 0.011% (circled "marks") to 0.004% (underlined "marks") causes the "mark" to drop by 50 points to bring it largely below 140 which is a "mark" for which difficulties in TIG welding are not encountered.

Figure 4:
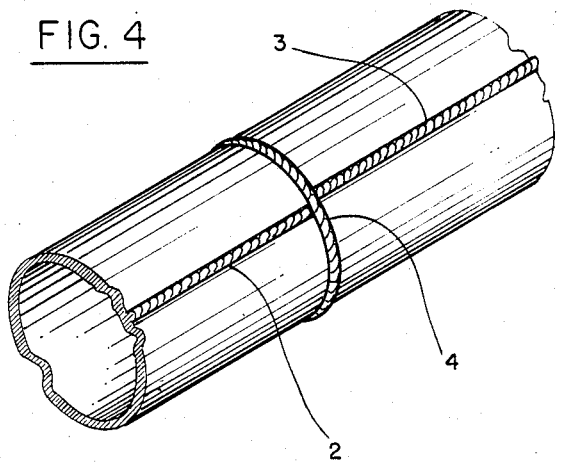
FIG. 4 an example of structural element for which the alloys according to the invention are specially adapted.

The applications of the alloys according to the invention are those where these alloys introduce a mean coefficient of expansion less than $2.5\times10^{-6}$°C. under cryogenic conditions and a ductility gap sufficiently attenuated to permit welds, in particular of weld intersections. The alloys according to the invention are adapted to welded constructional elements operating under cryogenic conditions and having weld intersections produced with metal fusion in the weld zones of said elements. FIG. 4 shows a cryogenic pipe in which the annular weld bead 1 intersects the longitudinal weld beads 2 and 3. The alloys according to the invention are specially adapted to such parts having weld intersections.

It is, of course, well understood that it is possible without departing from the scope of the invention to conceive modifications and improvements in detail and even to envisage the use of equivalent means.

I claim:

1. A manufactured structural element for use under cryogenic conditions and containing at least one welded joint wherein said structural element and said welded joint each comprises an alloy consisting essentially by weight of about 35 to about 39 percent nickel, up to 20 percent cobalt, up to 0.25 percent silicon, up to 0.04 percent carbon, up to 0.004 percent sulfur, up to 0.008 percent phosphorous, about 0.2 to about 1.5 percent manganese, about 0.2 to about 0.5 percent titanium, and the balance iron and impurities.

2. A manufactured structured element according to claim 1 having at least one weld intersection.

3. A method for manufacturing a welded structural element having a mean coefficient of thermal expansion less than about $2.4\times10^{-6}$ per degree C. at cryogenic temperatures comprising heating to a temperature sufficiently high to weld together faying edges of one or more components without use of a filler alloy, said components comprising an alloy consisting essentially of, by weight, about 35 to about 39 percent nickel, up to 20 percent cobolt, up to 0.25 percent silicon, up to 0.04 percent carbon, up to 0.004 percent sulfur, up to 0.008 percent phosphorous, about 0.2 to about 1.5 percent manganese, about 0.2 to about 0.5 percent titanium and the balance iron and impurities, said faying edges making adequate contact with each other at the welding temperatures to fuse together and form a welded joint.

* * * * *